US008348785B2

(12) United States Patent
Chen et al.

(10) Patent No.: US 8,348,785 B2
(45) Date of Patent: Jan. 8, 2013

(54) GOLF-CLUB HEAD HAVING A STRIKING PLATE MADE OF HIGH-STRENGTH ALUMINUM ALLOY

(75) Inventors: Chan-Tung Chen, Ksohsiung (TW); Chun-Yung Huang, Kaohsiung County (TW); Ching-Fen Lee, Kaohsiung (TW); Chun-Wei Chen, Tainan (TW)

(73) Assignee: Fusheng Precision Co., Ltd., Taipei (TW)

( * ) Notice: Subject to any disclaimer, the term of this patent is extended or adjusted under 35 U.S.C. 154(b) by 487 days.

(21) Appl. No.: 12/401,316

(22) Filed: Mar. 10, 2009

(65) Prior Publication Data

US 2010/0234133 A1 Sep. 16, 2010

(51) Int. Cl.
*A63B 53/04* (2006.01)

(52) U.S. Cl. ..... 473/342

(58) Field of Classification Search ..... 473/342
See application file for complete search history.

(56) References Cited

U.S. PATENT DOCUMENTS

| | | | | |
|---|---|---|---|---|
| 6,443,854 | B1 * | 9/2002 | Calboreanu | 473/324 |
| 6,520,868 | B2 | 2/2003 | Chen | |
| 6,617,050 | B2 | 9/2003 | Chao | |
| 7,232,380 | B2 * | 6/2007 | Nakahara | 473/324 |
| 7,452,429 | B2 * | 11/2008 | Boselli et al. | 148/417 |

* cited by examiner

*Primary Examiner* — Michael Dennis
(74) *Attorney, Agent, or Firm* — Muncy, Geissler, Olds & Lowe, PLLC

(57) ABSTRACT

Disclosed is a golf club head having a striking plate made of a high-strength aluminum alloy including at most 0.06 wt % of Si, at most 0.1 wt % of Fe, 2 to 2.5 wt % of Cu, 1.5 to 2.5 wt % of Mg, 5 to 9.5 wt % of Zn, at most 0.05 wt % of Mn, 0.1 to 0.2 wt % of Zr, at most 0.05 wt % of Cr, at most 0.05 wt % of Ti, 0.01 to 0.1 wt % of Sc, and balance Al, wherein the weight ratio of Zn over Mg is from about 3.2 to about 4.4.

18 Claims, 6 Drawing Sheets

GOLF-CLUB HEAD HAVING A STRIKING PLATE MADE OF HIGH-STRENGTH ALUMINUM ALLOY

BACKGROUND

1. Field of Invention

The present invention relates to a golf club head, and more specially to a golf club head with a striking plate made of a high-strength aluminum ally.

2. Description of Related Art

Golf club heads of different club numbers typically have different weight specification, e.g. a number 5 golf club having a head weight of about 256 grams. The striking plate of a conventional golf club head is made of a high-strength stainless steel for lowering the club head's center-of-gravity. Although the thickness of one striking plate made of a high-strength stainless steel can be decreased to 2.1 mm, a 2.1 mm-thick striking plate designed to be assembled in a golf club head with a total weight of about 244.87 grams still weigh about 57.59 grams due to the high density of the stainless steel (e.g., about 7.8 g/cm$^3$). Since a striking plate of high-strength stainless steel still makes up a relatively large ratio of the club head in weight, it is undesired to use a striking plate of high-strength stainless steel to adjust the golf club head's center-of-gravity.

For obtaining a better ball-impacting performance by adjusting the golf club head's center-of-gravity, it is necessary to redistribute more weight from the striking plate to the other portions of the golf club head while keeping the club head's total weight unchanged. When a 2.8 mm-thick striking plate designed to be assembled in the golf club head with a total weight of about 244.87 grams is made of a titanium alloy having a density of about 4.5 g/cm$^3$, the weight of the 2.8 mm-thick striking plate cancan be decreased to about 44.46 grams.

So far as material density is concerned, aluminum alloy (density 2.7 g/cm$^3$) is a better material for manufacturing the striking plate. In theory, the striking plate's weight may be significantly reduced by using aluminum alloy. However, besides considering density and weight, the striking plate's other mechanical properties, such as strength, elongation and toughness, should also be taken into consideration since the striking plate is directly hit by the golf ball, wherein the mechanical properties are mainly related to the fatigue life of the club head's striking plate.

When a conventional high-strength aluminum alloy, such as a 7075 precipitation-hardening alloy in 7 series alloys, is used for manufacturing a club head's striking plate, its thickness should be increased to meet what a golf club head requires from the striking plate since the mechanical properties of conventional high-strength aluminum alloy cannot meet the needs. Accordingly, conventional high-strength aluminum alloy cannot be adopted to significantly reduce the weight of the striking plate of a golf club head thereby failing to significantly lower the golf club head's center-of-gravity.

SUMMARY

It is an object of the present invention to provide a golf club head having a striking plate made of a high-strength aluminum alloy for significantly reducing the striking plate's thickness and thereby lowering the golf club head's center-of-gravity.

To achieve the above listed and other objects, the present invention provides a golf club head having a striking plate made of a high-strength aluminum alloy. The golf club head mainly includes a striking plate and a main body constituting the remainder of the golf club head. The striking plate has a striking face for impacting a golf ball. The thickness of the striking plate is from about 2.7 mm to about 3.7 mm.

In the golf club head of the present invention, the high-strength aluminum alloy for manufacturing the striking plate includes at most 0.06 wt % of Si, at most 0.1 wt % of Fe, 2 to 2.5 wt % of Cu, 1.5 to 2.5 wt % of Mg, 5 to 9.5 wt % of Zn, at most 0.05 wt % of Mn, 0.1 to 0.2 wt % of Zr, at most 0.05 wt % of Cr, at most 0.05 wt % of Ti, 0.01 to 0.1 wt % of Sc, and balance Al, wherein the weight ratio of Zn over Mg is from about 3.2 to about 4.4.

The present invention provides much more freedom in adjusting a golf club head's center-of-gravity by using a striking plate having a relatively thin thickness while the mechanical properties thereof still meet the needs of the golf club head.

BRIEF DESCRIPTION OF THE DRAWINGS

Aspects of the present disclosure are best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion. In the accompanying figures.

DESCRIPTION OF THE PREFERRED EMBODIMENTS

Figure 1A:
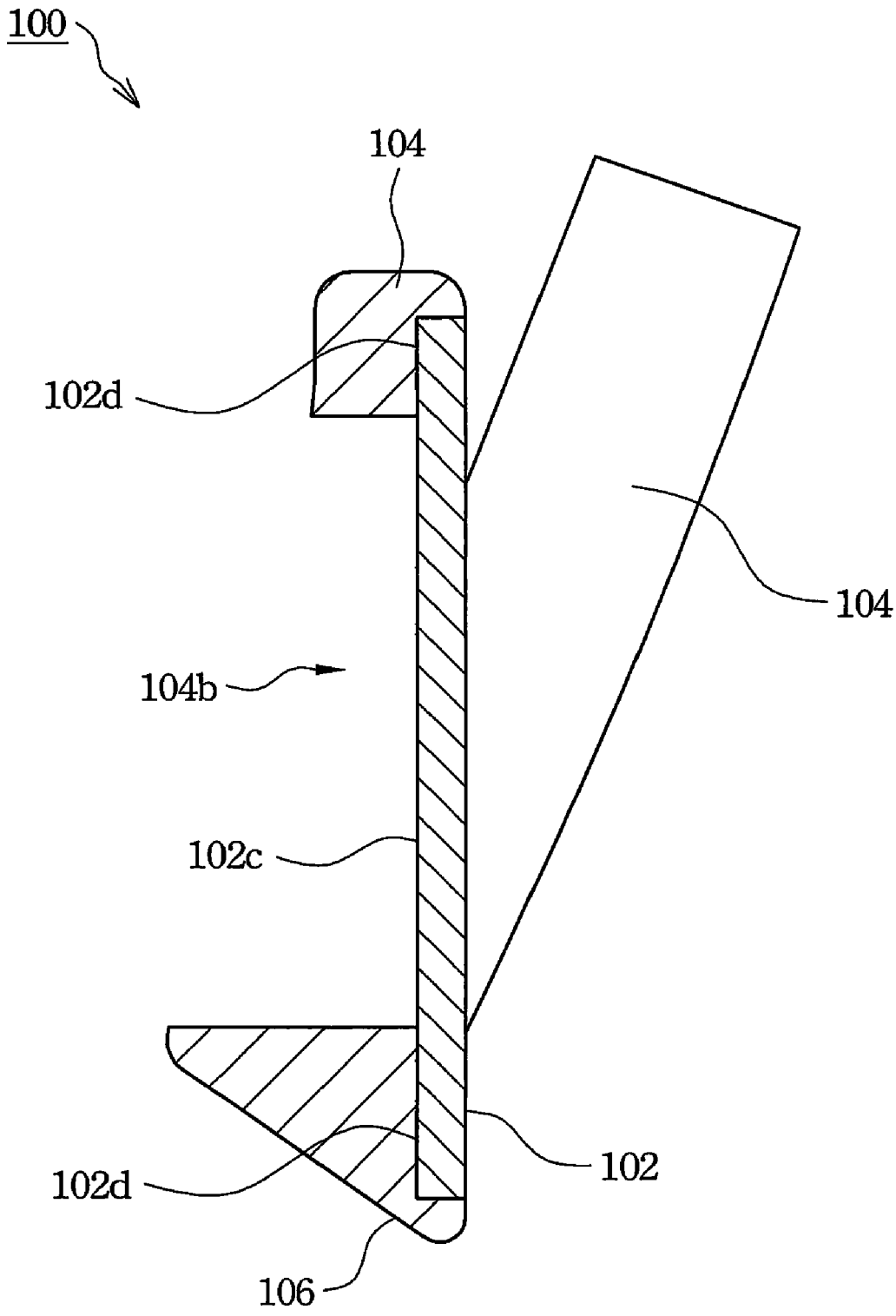
FIG. 1A is a sectional view of a golf club head having the striking plate made of a high-strength aluminum alloy according to one embodiment of the present invention.
Figure 1B:
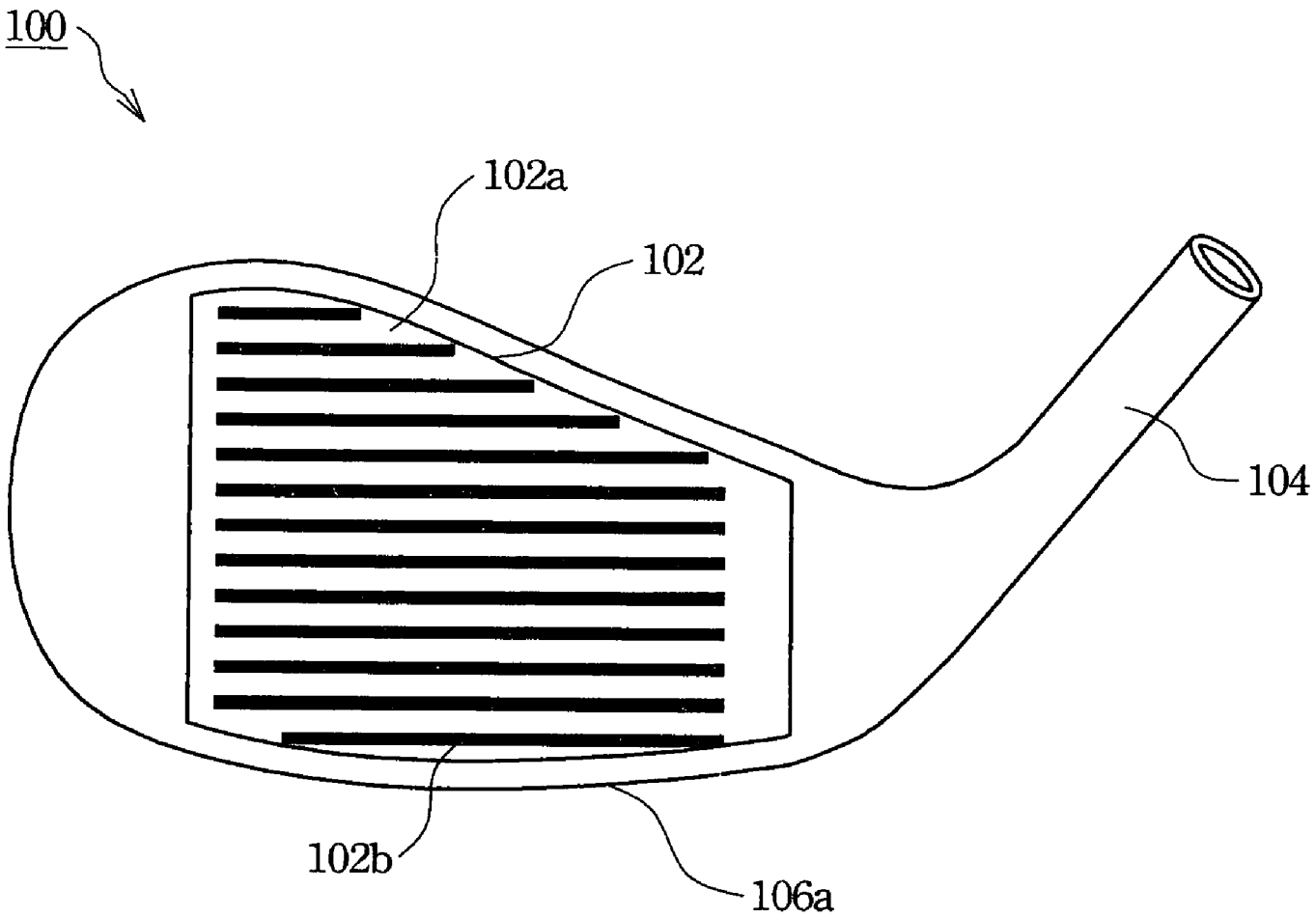
FIG. 1B is a front view of the golf club head of FIG. 1A.

FIGS. 1A and 1B show a golf club head 100 according to one embodiment of the present invention. The golf club head 100 includes a striking plate 102 and a main body 104. The main body 104 can be made of carbon steel (e.g. carbon steel corresponding to JIS S20C or S25C), stainless steel (e.g. 17-4PH stainless steel), alloy steel, Fe—Mn—Al alloy, nickel based alloys, cast iron, super alloy steel, pure titanium, titanium alloy (e.g. Ti6Al4V or Cp-Ti), aluminum alloy, magnesium alloy, or copper alloy. The striking plate 102 and the main body 104 can be integrally formed together as one unit through casting, powder sintering, forging, machining, and the like. Alternatively, the golf club head 100 of the present invention may be manufactured by casting the main body 104 having a striking plate 102-fitting opening by a lost wax method, fitting the striking plate 102 in the opening, and welding the striking plate 102 to the main body 104. If a welding process is applied to the striking plate 102 and the main body 104, the welded golf club head 100 may be further subjected to grinding, polishing or age hardening. Furthermore, the striking plate 102 to be welded to the main body 104 can be manufactured through extrusion, casting, or rolling.

Referring to FIG. 1B, the striking plate 102 has a striking face 102*a* for impacting a golf ball. A plurality of score lines 102*b* are formed on the striking face 102*a*, wherein the score lines 102*b* extend horizontally in a direction substantially parallel to the bottom 106 of the golf club head 100. Furthermore, in the golf club head 100, the main body 104 constitutes the remainder of the golf club head 100 except the striking plate 102. In this embodiment, the striking plate 102 includes a rear face 102*c* (see FIG. 2) opposite to the striking face 102*a*, wherein the peripheral area 102*d* of the rear face 102*c* is connected to the main body 104, and the remainder of the rear face 102*c* is exposed through a through hole 104*b* (see FIG. 2) of the main body 104.

Figure 2:
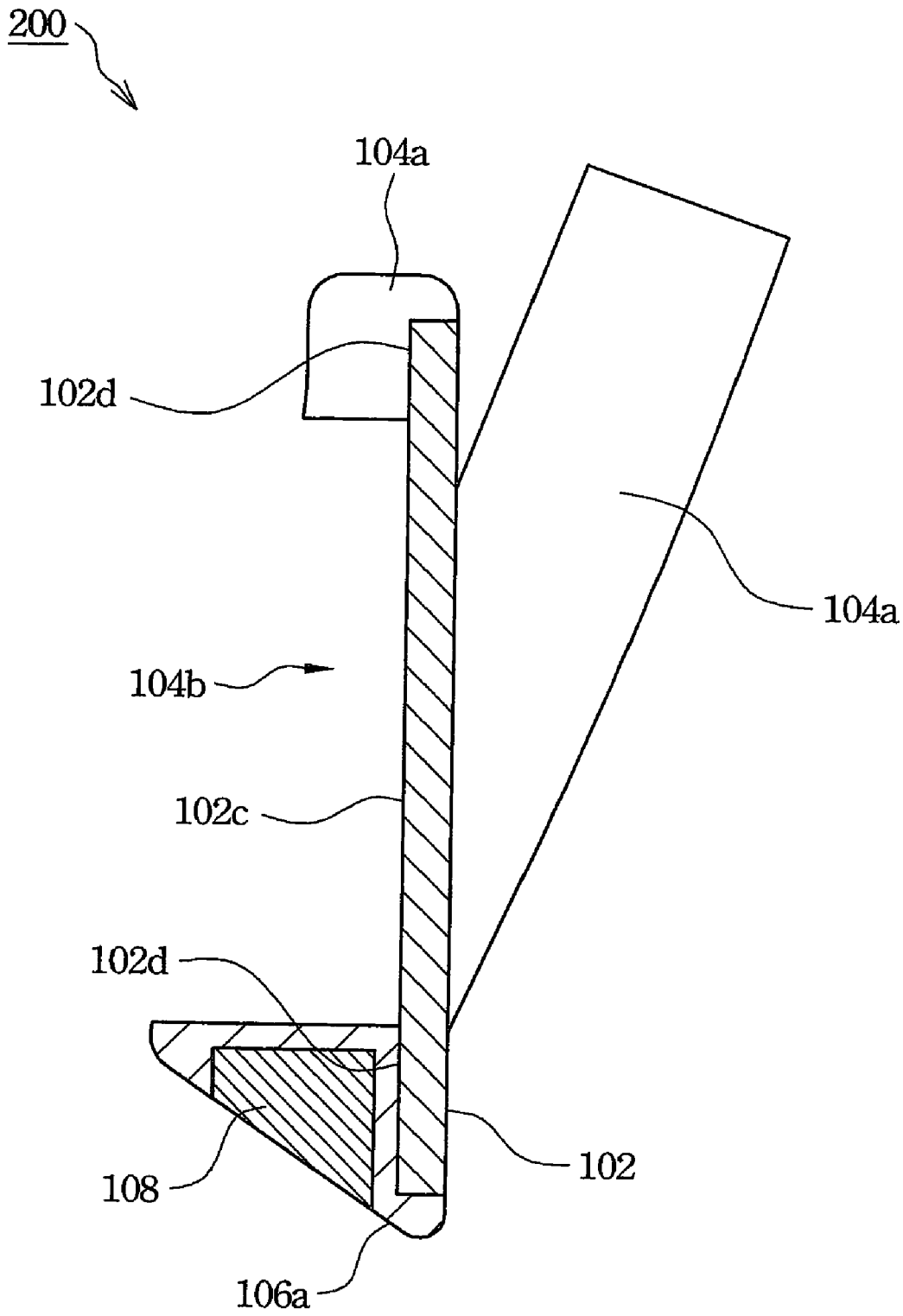
FIG. 2 is a sectional view of a golf club head having the striking plate made of a high-strength aluminum alloy according to another embodiment of the present invention.

FIG. 2 shows a golf club head 200 according to another embodiment of the present invention. The golf club head 200 is substantially same as the golf club head 100 except that the golf club head 200 further includes a balance weight 108, which is disposed at the bottom portion 106*a* of the main body 104*a*. The balance weight 108 can be made of a material having a specific gravity higher than that of the main body 104*a*, such as tungsten alloy, W—Fe—Ni alloy, copper alloy or combinations thereof. The balance weight 108 can be manufactured through casting, forging, powder metallurgy, and the like. The balance weight may have a specific gravity of from about 8 to about 18.

Compositions of High-strength aluminum alloys suitable for use in manufacturing the striking plate of the present invention are listed in Table 1.

TABLE 1

| Composition | Weight percent (wt %) | Composition | Weight percent (wt %) | Composition | Weight percent (wt %) |
|---|---|---|---|---|---|
| Si | <0.06 | Zn | 5~9.5 | Ti | <0.05 |
| Fe | <0.1 | Mn | <0.05 | Sc | 0.01~0.1 |
| Cu | 2~2.5 | Zr | 0.1~0.2 | Al | Balance |
| Mg | 1.5~2.5 | Cr | <0.05 | Zn:Mg | 3.2~4.4 |

The reasons for limiting the composition of the high-strength aluminum alloy are stated below.

In the high-strength aluminum alloy of the present invention, Si and Fe are considered as impurities which may be present under a specific content. If the content of Si is too much, a precipitation of Si will be found in the aluminum alloy, or Si will react with Sc to form a precipitation of ScSi or $Sc_2AlSi_2$ in the aluminum alloy thereby adversely affecting the mechanical property of the aluminum alloy. Accordingly, the content of Si is preferably limited to at most 0.06 wt % of the high-strength aluminum alloy. Too much content of Fe will cause a precipitation of $Al_3Fe$ in the high-strength aluminum alloy thereby reducing the recrystallization temperature of the aluminum alloy and the precipitation of $Al_3Fe$ will easily become the source of cracks to reduce the fracture toughness of the aluminum alloy. Therefore, the content of Fe is preferably limited to at most 0.1 wt % of the high-strength aluminum alloy.

Proper content of Cu is added to the high-strength aluminum alloy of the present invention for forming the compound of $CuAl_2$, facilitating GP (Guinier-Preston) zone formation, and for furthermore increasing the elongation at break of the high-strength aluminum alloy at room temperature to increase the toughness of the striking plate 102 made of the aluminum alloy and raise the low cycle fatigue life of the striking plate 102. In the present invention, the content of Cu is preferably in a range from 2 wt % to 2.5 wt % of the high-strength aluminum alloy, and that can lead to an increase of 1 to 2% of the elongation of the high-strength aluminum alloy used in the striking plate 102 under room temperature. When the content of Cu is less than 2 wt %, it is too low to significantly improve the toughness of the high-strength aluminum alloy. When the content of Cu is more than 2.5 wt %, the hot cracking susceptibility is increased during welding.

Since more content of Zn can facilitate the quenching reaction, for obtaining a better quenching reaction in a high-strength aluminum alloy, the content of Zn in the high-strength aluminum alloy used in the striking plate 102 of the present invention is raised. In certain embodiments, the content of Zn is in a range from 5 wt % to 9.5 wt % of the striking plate 102. The more content of Zn, the more difficult to overcome a hot crack in a solidification process of the aluminum alloy will be. Accordingly, the content of Zn is preferably at most 9.5 wt % of the high-strength aluminum alloy.

Mg is a major precipitation-strengthening-phase. The content of Mg is preferably in a range from 1.5 wt % to 2.5 wt % of the high-strength aluminum alloy. If the content of Mg is more than 2.5 wt %, it will reduce the resistance to stress corrosion. In contrast, if the content of Mg is less than 1.5 wt %, it will reduce the mechanical properties.

Besides, for improving the mechanical properties of the aluminum alloy, such as the tensile strength, the weight ratio of Zn over Mg in the high-strength aluminum alloy of the present invention used in the striking plate 102 is set in a range from about 3.2 to about 4.4. In addition to obtaining a higher strength, raising the weight ratio of Zn over Mg in the high-strength aluminum alloy can also significantly facilitate the formation of the Al—Zn—Mg compound thereby enhancing the corrosion resistance of the high-strength aluminum alloy and significantly improving the mechanical properties. Since the stress corrosion cracking (SCC) is first increased with an increase in the weight ratio of Zn over Mg and then decreased with further increase in the weight ratio, it adversely affect the SCC if the weight ratio of Zn over Mg is too high or too low.

The main purpose for adding Mn, Cr and Ti to the high-strength aluminum alloy is to refine grains. Although Mn, Cr and Ti can improve the dispersion of precipitations and refine grains, too much content thereof will raise the quench sensitivity and is adverse to the uniformity of mechanical properties in different thickness after a heat treatment. Accordingly, the content of Cr is preferably at most 0.05 wt % of the high-strength aluminum alloy, and the content of Mn or Ti is preferably at most 0.05 wt % of the high-strength aluminum alloy.

In certain embodiments of the present invention, for improving welding properties, 0.05 to 0.1 wt % of Sc and 0.1 to 0.2 wt % of Zr are added to the high-strength aluminum alloy used to manufacture the striking plate 102. Furthermore, adding of Sc and Zr not only can improve the welding properties and increase the tensile strength by 52 to 107 Mpa but also can lead to an increase of 3 to 5% of the elongation of the high-strength aluminum alloy. Because of the high price of Sc, too much content of Sc, i.e., more than 0.1 wt %, will significantly increase cost and adversely affect the product development and the product promotion. When the content of Zr is less than 0.01 wt %, it is too low to significantly improve the welding properties of the aluminum alloy. The content of Zr is preferably in a range from 0.1 to 0.2 wt % of the high-strength aluminum alloy. Adding Zr to the aluminum alloy can improve mechanical properties of the aluminum alloy, but too much content of Zr can cause coarse and columnar grains which adversely affects the mechanical properties. Too less content of Zr cannot significantly raise the elongation of the aluminum alloy.

Embodiment

Manufacturing Golf Club Head Having Striking Plate Made of High-Strength Aluminum Alloy First, high-strength aluminum alloys having the respective compositions indicated in Table 2 were prepared and extruded to form the striking plates. At the same time, aluminum alloy main bodies each having a striking plate-fitting opening and balance weights of tungsten alloy were manufactured by a metal casting process. Hereafter, the striking plates and the balance weights were welded to the main bodies thereby completing the golf club heads numbered with 1 to 6. The shape of the golf club heads is substantially identical with that shown in FIG. 2.

TABLE 2

| Number | Si Wt % | Fe Wt % | Cu Wt % | Mg Wt % | Zn Wt % | Mn Wt % | Zr Wt % | Cr Wt % | Ti Wt % | Sc Wt % | Al Wt % | Zn:Mg (weight ratio) | Tensile Strength (Ksi) |
|---|---|---|---|---|---|---|---|---|---|---|---|---|---|
| 1 | 0.04 | 0.06 | 2.3 | 1.9 | 7.5 | 0.04 | 0.15 | 0.04 | 0.01 | 0.10 | Bal. | 3.9 | 109 |
| 2 | 0.05 | 0.04 | 2.4 | 1.9 | 6.4 | 0.05 | 0.13 | 0.01 | 0.01 | 0.04 | Bal. | 3.4 | 94 |
| 3 | 0.06 | 0.01 | 2.3 | 2.4 | 7.7 | 0.03 | 0.10 | 0.05 | 0.05 | 0.02 | Bal. | 3.2 | 116 |
| 4 | 0.03 | 0.02 | 2.5 | 1.8 | 6.7 | 0.04 | 0.11 | 0.03 | 0.03 | 0.08 | Bal. | 3.7 | 97 |
| 5 | 0.01 | 0.05 | 2.4 | 2.0 | 8.5 | 0.02 | 0.13 | 0.02 | 0.02 | 0.06 | Bal. | 4.3 | 122 |
| 6 | 0.04 | 0.09 | 2.5 | 1.9 | 8.3 | 0.05 | 0.20 | 0.03 | 0.01 | 0.10 | Bal. | 4.4 | 118 |

Figure 3:
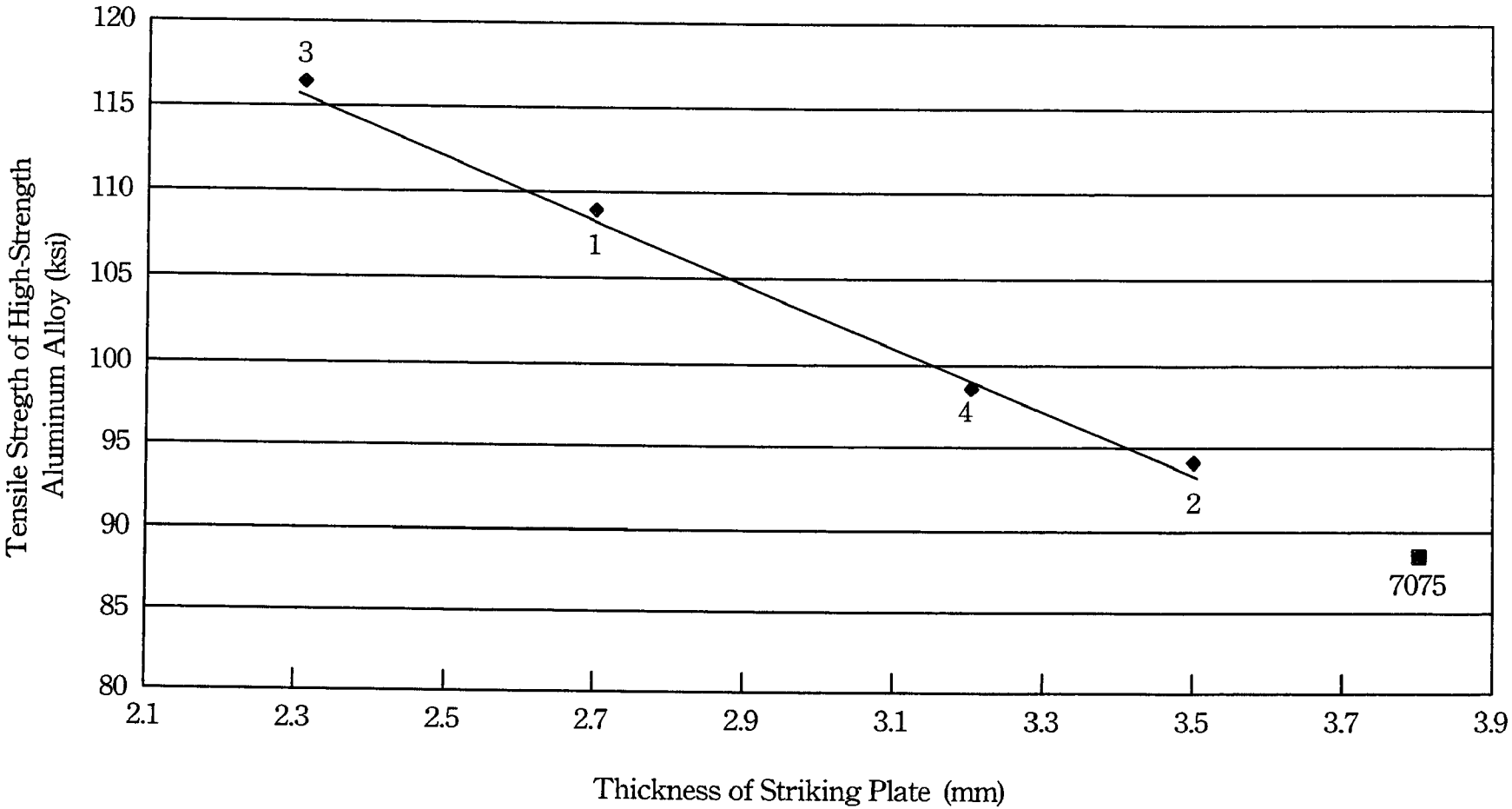
FIG. 3 shows a correlation curve between the thickness of a striking plate required to pass a cannon shot test and the tensile strength of a high-strength aluminum alloy used to manufacture the striking plate according to one embodiment of the present invention.

FIG. 3 shows a correlation curve between the minimum thickness of a striking plate required to pass a cannon shot test and the tensile strength of the high-strength aluminum alloy used to manufacture the striking plate. The numbers 1 to 4 represent the results of the golf club heads numbered with 1 to 4. The cannon shot test was conducted as follow. The to-be-tested club head was allowed to strike golf balls 3000 times at the head speed of 50 m/s, and thereafter the striking plate was checked for deformation. The permanent deformation of the striking plate is set to be at most 0.15 mm. As shown in FIG. 3 and Table 2, the high-strength aluminum alloy used in the number 1 golf club head has a tensile strength of 109 Ksi, and the minimum thickness of the striking plate required to pass the cannon shot test is about 2.7 mm. The high-strength aluminum alloy used in the number 2 golf club head has a tensile strength of 94 Ksi, and the minimum thickness of the striking plate required to pass the cannon shot test is about 3.5 mm. Furthermore, the high-strength aluminum alloys used in the number 3 and number 4 golf club heads respectively have tensile strength of 116 Ksi and of 97 Ksi, and the minimum thickness of the striking plates required to pass the cannon shot test are about 2.3 mm and 3.2 mm, respectively.

In FIG. 3, the number 7075 represents the result of a striking plate made of a conventional high-strength aluminum alloy. The tensile strength of the conventional high-strength aluminum alloy is about 87 Ksi, and the minimum thickness of the striking plate made of the conventional high-strength aluminum alloy required to pass the cannon shot test is about 3.8 mm.

The geometrical dimensions of the number 1 and number 2 golf club heads and the striking plates thereof are listed in Table 3 below. Furthermore, Table 3 also shows the geometrical dimensions of two conventional golf club heads and the striking plates thereof, wherein the striking plates are respectively made of a conventional stainless steel and a conventional titanium alloy, e.g. Ti6Al4V. It is noted that the golf club heads in Table 3 have substantially the same total weight, which is about 244.88 grams, and have substantially identical exterior dimensions.

TABLE 3

Figure 4A:
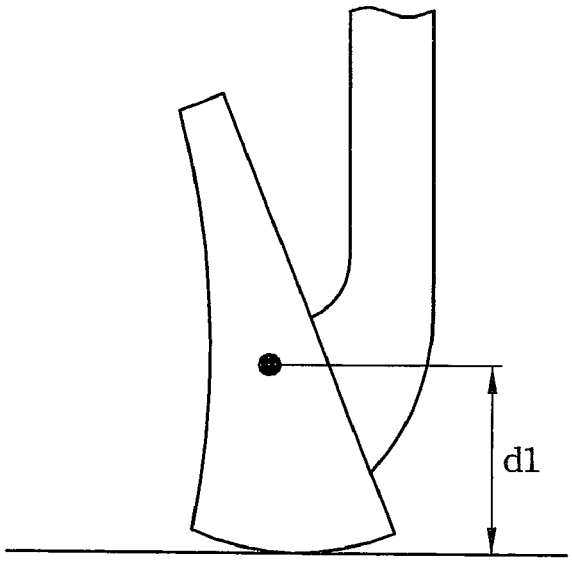
FIG. 4A is a side view showing the height definition of the center-of-gravity of a golf club head.
Figure 4B:
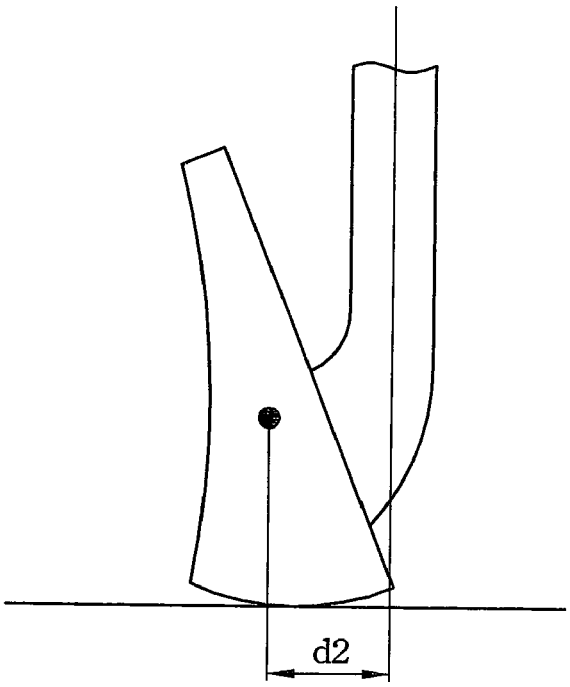
FIG. 4B is a side view showing the depth definition of the center-of-gravity of a golf club head.
Figure 4C:
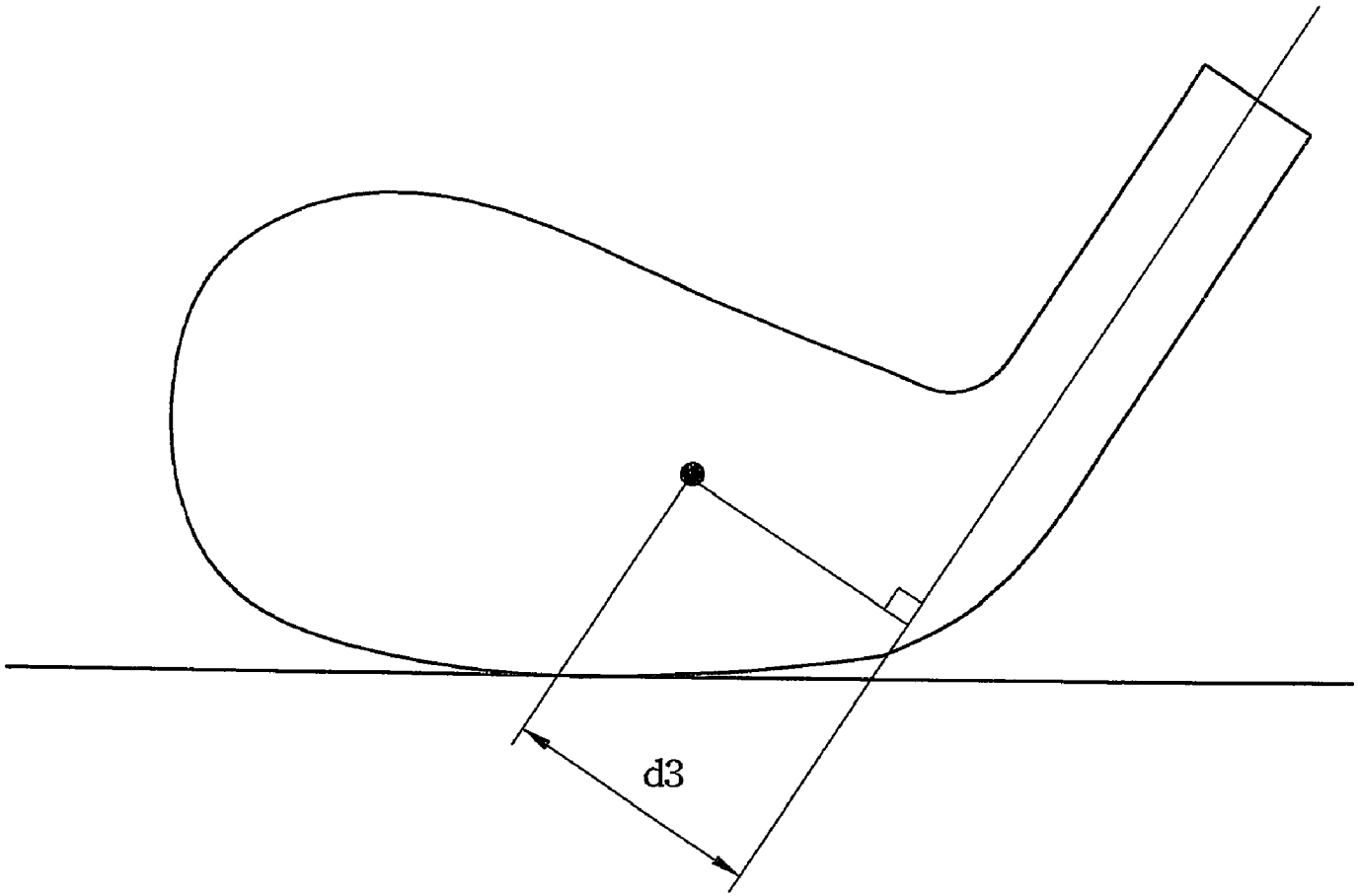
FIG. 4C is a front view showing the distance definition of the center-of-gravity of a golf club head.

| | Number 1 golf club head | Number 2 golf club head | Conventional golf club head 1 | Conventional golf club head 2 |
|---|---|---|---|---|
| Material of Striking Plate | High-Strength Aluminum Alloy | High-Strength Aluminum Alloy | High-Strength Stainless Steel | Titanium Alloy |
| Thickness of Striking Plate (mm) | 2.7 | 3.5 | 2.1 | 2.8 |
| Weight of Striking Plate (g) | 25.71 | 33.41 | 57.59 | 44.46 |
| Total Weight of Golf Club Head (g) | 244.89 | 244.89 | 244.87 | 244.88 |
| Height of Center-of-gravity of Golf Club Head d1 (mm) (see FIG. 4A) | 15.38 | 15.44 | 17.56 | 16.61 |
| Depth of Center-of-gravity of Golf Club Head d2 (mm) (see FIG. 4B) | 14.82 | 14.79 | 13.83 | 14.36 |
| Distance of Center-of-gravity of Golf Club Head d3 (mm) (see FIG. 4C) | 38.56 | 38.87 | 40.43 | 39.59 |

The golf club heads listed in Table 3 have substantially the same shape outline and the same area of striking plate besides having the same total weight. From the data listed in Table 3, a striking plate made of the high-strength aluminum alloy of the present invention can be reduced in weight by 42.3% to 55.5% as compared with that made of the conventional high-strength stainless steel and by 25.0% to 42.2% as compared with that made of the conventional titanium alloy. Furthermore, the golf club head of the present invention can lower the center-of-gravity thereof by 12.0% to 12.4% as compared with that having the striking plate made of the conventional high-strength stainless steel and by 7.0% to 7.4% as compared with that having the striking plate made of the conventional titanium alloy. The depth of center-of-gravity of a golf club head having the striking plate made of the high-strength aluminum alloy of the present invention can be raised by 6.5% to 6.7% as compared with that having the striking plate made of the conventional high-strength stainless steel and by 2.9% to 3.1% as compared with that having the striking plate made of the conventional titanium alloy.

Table 2 shows that the tensile strength of the high-strength aluminum alloy of the present invention can reach up to 122 Ksi (see the tensile strength of the high-strength aluminum alloy used in the number 5 golf club head in table 2). According to the tendency shown in FIG. 3, the minimum thickness of the number 5 golf club head in Table 2 required to pass the cannon shot test is assumed to be less than 2.7 mm, i.e., the minimum thickness of the number 1 golf club head. The tested result matches the tendency. In actual applications, the properties of the high-strength aluminum alloy for manufacturing striking plates are between the properties of the high-strength aluminum alloys used in the number 1 and number 2 golf club heads in FIG. 3, i.e., the tensile strength thereof is between 94 Ksi and 109 Ksi, and the minimum thickness thereof required to pass the cannon shot test is between 2.7 mm and 3.7 mm.

According to the aforementioned description, since SCC is first increased with an increase in the weight ration of Zn over Mg and then decreased with further increase in the weight ratio, it adversely affect the SCC if the weight ration of Zn over Mg is too high or too low. Therefore, the weight ratio of Zn over Mg in Table 1 is set in a range from about 3.2 to about 4.4.

To sum up, by using the high-strength aluminum alloy of the present invention to manufacture the striking plate of a golf club head, the tensile strength of the striking plate becomes higher than the tensile strength (87 Ksi) of the striking plate made of the conventional 7075 high-strength aluminum alloy (see FIG. 3), and the striking plate has an elongation of at least 5%. Furthermore, by using the high-strength aluminum alloy of the present invention to manufacture the striking plate of a golf club head, the minimum thickness of the striking plate required to pass the cannon shot test becomes, though not limited to, 2.7 mm-3.7 mm.

In certain embodiments, for raising the corrosion resistance and wear resistance of the striking plate of a golf club head, the surface of the striking plate can be treated by a hard anodizing treatment for forming a hard anodizing film having a thickness of from 5 μm to 30 μm. In certain embodiments, the striking plate of a golf club head can be manufactured through extruding an aluminum ingot. For raising mechanical properties of the striking plate of the golf club head, the striking plate made of the high-strength aluminum alloy can be treated with a T6-type or T6x-type heat treatment.

The foregoing has outlined features of several embodiments so that those skilled in the art may better understand the detailed description that follows. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A golf club head comprising: a striking plate made of a high-strength aluminum alloy, the striking plate having a striking face for impacting a golf ball; and a main body constituting the remainder of the golf club head, wherein the main body is made of carbon steel, stainless steel, alloy steel, Fe—Mn—Al alloy, nickel based alloys, cast iron, super alloy steel, pure titanium, titanium alloy, magnesium alloy, copper alloy or aluminum alloy different from that forming the striking plate, wherein the high-strength aluminum alloy comprises at most 0.06 wt % of Si, at most 0.1 wt % of Fe, 2 to 2.5 wt % excluding 2 wt % of Cu, 1.5 to 2.5 wt % of Mg, 5 to 9.5 wt % of Zn, at most 0.05 wt % of Mn, 0.1 to 0.2 wt % of Zr, at most 0.05 wt % of Cr, at most 0.05 wt % of Ti, 0.01 to 0.1 wt % of So, and balance Al, wherein the weight ratio of Zn over Mg is from about 3.2 to about 4.4; wherein the surface of the striking plate has a hard anodizing film and the thickness of the hard anodizing film is in a range from 5 μm to 30 μm.

2. The golf club head of claim 1, wherein the thickness of the striking plate is from about 2.7 mm to about 3.7 mm.

3. The golf club head of claim 1, wherein the striking plate is an extrusion plate.

4. The golf club head of claim 1, wherein the striking plate is a plate treated with a T6-type or T6x-type heat treatment.

5. The golf club head of claim 1, wherein the tensile strength of the striking plate is in a range from 87 Ksi to 122 Ksi.

6. The golf club head of claim 1, wherein the elongation of the striking plate is at least 5%.

7. The golf club head of claim 1, wherein the center-of-gravity of the golf club head is lower than that of another golf club head with a titanium striking plate by at least 7% on condition that the two golf club heads have substantially the same total weight and exterior dimensions.

8. The golf club head of claim 1, wherein the center-of-gravity of the golf club head is lower than that of another golf club head with a high-strength stainless steel striking plate by at least 12% on condition that the two golf club heads have substantially the same total weight and exterior dimensions.

9. The golf club head of claim 1, wherein the height of the golf club head's center-of-gravity is less than 16 mm.

10. The golf club head of claim 9, wherein the thickness of the striking plate is less than 3.5 mm.

11. The golf club head of claim 1, wherein the main body has a through hole defined therein, the striking plate has a rear face opposite to the striking face, and the rear face comprises a peripheral area connected to the main body and the remainder of the rear face is exposed through the through hole of the main body.

12. The golf club head of claim 1, further comprising a balance weight disposed at the bottom portion of the main body.

13. A golf club head comprising: a striking plate made of a high-strength aluminum alloy, the striking plate having a striking face for impacting a golf ball and a rear face opposite to the striking face; and a main body constituting the remainder of the golf club head, the main body having a through hole defined therein, wherein the main body is made of carbon steel, stainless steel, alloy steel, Fe—Mn—Al alloy, nickel based alloys, cast iron, super alloy steel, pure titanium~titanium alloy, magnesium alloy, copper alloy or aluminum alloy different from that forming the striking plate, wherein the striking plate is securely attached to the main body with the central region of the rear face thereof exposed through the through hole of the main body, wherein the high-strength aluminum alloy comprises at most 0.06 wt % of Si, at most 0.1 wt % of Fe, 2 to 2.5 wt % excluding 2 wt % of Cu, 1.5 to 2.5 wt % of Mg, 5 to 9.5 wt % of Zn, at most 0.05 wt % of Mn, 0.1 to 0.2 wt % of Zr, at most 0.05 wt % of Cr, at most 0.05 wt % of Ti, 0.01 to 0.1 wt % of Sc, and balance Al, wherein the weight ratio of Zn over Mg is from about 3.2 to about 4.4; wherein the surface of the striking plate has a hard anodizing film and the thickness of the hard anodizing film is in a range from 5 μm to 30 μm.

14. The golf club head of claim 13, wherein the elongation of the striking plate is at least 5%.

15. The golf club head of claim 13, wherein the center-of-gravity of the golf club head is lower than that of another golf club head with a titanium striking plate by at least 7% on condition that the two golf club heads have substantially the same total weight and exterior dimensions.

16. A golf club head comprising: a striking plate made of a high-strength aluminum alloy, the striking plate having a striking face for impacting a golf ball; a main body constituting the remainder of the golf club head, wherein the main body is made of carbon steel, stainless steel, alloy steel, Fe—Mn—Al alloy, nickel based alloys, cast iron, super alloy steel, pure titanium, titanium alloy, magnesium alloy, copper alloy or aluminum alloy different from that forming the striking plate; and a balance weight having a specific gravity of from about 8 to about 18 disposed at the bottom portion of the main body, wherein the high-strength aluminum alloy comprises at most 0.06 wt % of Si, at most 0.1 wt % of Fe, 2 to 2.5 w-t % excluding 2 wt % of Cu, 1.5 to 2.5 wt % of Mg, 5 to 9.5 wt % of Zn, at most 0.05 wt % of Mn, 0.1 to 0.2 wt % of Zr, at most 0.05 wt % of Cr, at most 0.05 wt % of Ti, 0.01 to 0.1 wt % of So, and balance Al, wherein the weight ratio of Zn over Mg is from about 3.2 to about 4.4; wherein the surface of the striking plate has a hard anodizing film and the thickness of the hard anodizing film is in a range from 5 μm to 30 μm.

17. The golf club head of claim 16, wherein the elongation of the striking plate is at least 5%.

18. The golf club head of claim 16, wherein the center-of-gravity of the golf club head is lower than that of another golf club head with a titanium striking plate by at least 7% on condition that the two golf club heads have substantially the same total weight and exterior dimensions.

* * * * *